US009305564B2

(12) United States Patent
Disch et al.

(10) Patent No.: US 9,305,564 B2
(45) Date of Patent: Apr. 5, 2016

(54) APPARATUS AND METHOD FOR REPRODUCING AN AUDIO SIGNAL, APPARATUS AND METHOD FOR GENERATING A CODED AUDIO SIGNAL, COMPUTER PROGRAM AND CODED AUDIO SIGNAL

(71) Applicant: Fraunhofer-Gesellschaft zur Foerderung der angewandten Forschung e.V., Munich (DE)

(72) Inventors: Sascha Disch, Fuerth (DE); Benjamin Schubert, Nuremberg (DE); Markus Multrus, Nuremberg (DE); Christian Helmrich, Erlangen (DE); Konstantin Schmidt, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/634,118

(22) Filed: Feb. 27, 2015

(65) Prior Publication Data

US 2015/0170663 A1 Jun. 18, 2015

Related U.S. Application Data

(63) Continuation of application No. PCT/EP2013/067730, filed on Aug. 27, 2013.

(60) Provisional application No. 61/693,575, filed on Aug. 27, 2012.

(30) Foreign Application Priority Data

Oct. 4, 2012 (EP) ..... 12187265

(51) Int. Cl.

| | |
|---|---|
| ***G10L 19/00*** | (2013.01) |
| ***G10L 19/26*** | (2013.01) |
| ***G10L 21/038*** | (2013.01) |

(52) U.S. Cl.
CPC ..... *G10L 19/265* (2013.01); *G10L 19/0017* (2013.01); *G10L 21/038* (2013.01)

(58) Field of Classification Search
USPC ..... 704/500–504
See application file for complete search history.

(56) References Cited

U.S. PATENT DOCUMENTS 5,455,888 A 10/1995 Iyengar et al.
5,757,973 A * 5/1998 Wilkinson et al. ..... H04N 19/63 375/E7.047

(Continued)

FOREIGN PATENT DOCUMENTS

| | | | |
|---|---|---|---|
| EP | 2239732 | A1 | 10/2010 |
| WO | 9857436 | A2 | 12/1998 |
| WO | 2007118583 | A1 | 10/2007 |

OTHER PUBLICATIONS den Brinker et al, "An overview of the coding standard MPEG-4 Audio Amendments 1 and 2: HE-AAC, SSC and HE-AAC v2" 2009, in EURASIP J. Audio, Speech, Music Process., vol. 2009, pp. 1-24.*

(Continued)

*Primary Examiner* — Olujimi Adesanya
(74) *Attorney, Agent, or Firm* — Michael A. Glenn; Perkins Coie LLP

(57) ABSTRACT

An apparatus for reproducing an audio signal includes a first reproducer configured to reproduce a first portion of the audio signal in a first frequency band based on the first data. A provider is configured to provide a patch signal in a second frequency band, wherein the patch signal is at least partially uncorrelated with respect to the first portion of the audio signal or is at least partially a decorrelated version of the first portion of the audio signal, which has been shifted to the second frequency band. A second reproducer is configured to reproduce a second portion of the audio signal in the second frequency band based on second data and the patch signal. A combiner is configured to combine the reproduced first portion of the audio signal and the patch signal.

15 Claims, 11 Drawing Sheets

(56) References Cited

U.S. PATENT DOCUMENTS

| | | | | |
|---|---|---|---|---|
| 5,950,153 | A | 9/1999 | Ohmori et al. | |
| 6,895,375 | B2 | 5/2005 | Malah et al. | |
| 8,976,970 | B2 * | 3/2015 | Kim et al. | 381/22 |
| 2003/0093279 | A1 | 5/2003 | Malah et al. | |
| 2005/0096917 | A1 * | 5/2005 | Kjorling et al. | 704/500 |
| 2006/0140412 | A1 * | 6/2006 | Villemoes et al. | 381/12 |
| 2007/0038439 | A1 * | 2/2007 | Schuijers et al. | 704/212 |
| 2007/0238415 | A1 * | 10/2007 | Sinha et al. | 455/66.1 |
| 2008/0255831 | A1 * | 10/2008 | Tashiro et al. | 704/211 |
| 2008/0263285 | A1 * | 10/2008 | Sharma et al. | 711/147 |
| 2011/0099018 | A1 * | 4/2011 | Neuendorf et al. | 704/500 |
| 2011/0173006 | A1 * | 7/2011 | Nagel et al. | 704/500 |
| 2011/0202358 | A1 * | 8/2011 | Neuendorf et al. | 704/503 |
| 2012/0010879 | A1 * | 1/2012 | Tsujino et al. | 704/203 |
| 2014/0088978 | A1 * | 3/2014 | Mundt et al. | 704/500 |

OTHER PUBLICATIONS

Hsu, C. M. Liu and W. C. Lee "Audio patch method in audio decoders—MP3 and AAC", 2004, In Proc. AES 116th Conv., pp. 1-14.*

Ehret et al, "State-ofthe-Art Audio Coding for Broadcasting and Mobile Applications," 2003, in 114th AES Convention, Amsterdam, Mar. pp. 22-25, 2003.*

Ekstrand, "Bandwidth Extension of Audio Signals by Spectral Band Replication," 2002, in IEEE Benelux Workshop on Model based Processing and Coding of Audio (MPCA-2002), Leuven, Belgium, Nov. 15, 2002, pp. 53-58.*

Nagel et al, "A harmonic bandwidth extension method for audio codecs," 2009, In Acoustics, Speech and Signal Processing, 2009. ICASSP 2009. IEEE International Conference on , vol., no., pp. 145-148.*

Wolters et al, "A Closer Look into MPEG-4 High Efficiency AAC," presented at the AES115th Convention, New York, USA, 2003, pp. 1-16.*

Aarts, et al., "A Unified Approach to Low- and High-Frequency Bandwidth Extension", AES Convention Paper 5921, Presented at the 115th Convention, New York, USA, Oct. 2003, 16 pages.

Dietz, et al., "Spectral Band Replication, a novel approach in audio coding", 112th AES Convention, Munich, Germany, May 10, 2002, 8 pages.

Ehret, A. et al., "Audio Coding technology of ExAC", Proceedings of 2004 International Symposium on Intelligent Multimedia, Video and Speech Processing; Hong Kong; China, Oct. 20, 2004, 290-293.

ISO/IEC 14496-3, "Information technology—Coding of audio-visual objects—Part 3: Audio, Amendment 1: Bandwidth extensions".

Larsen, et al., "Efficient high-frequency bandwidth extension of music and speech", AES Convention Paper 5627, Presented at the 112th Convention, Munich, Germany, May 2002, 5 pages.

Larsen, E et al., "Audio Bandwidth Extension—Application to Psychoacoustics, Signal Processing and Loudspeaker Design", John Wiley & Sons, Ltd., 2004, 313 Pages.

Makhoul, J., "Spectral Analysis of Speech by Linear Prediction", IEEE Trans. Audio Electroacoust., AU-21(3) (1973), pp. 140-148, Jun. 1, 1973, 140-148.

Makinen, J et al., "AMR-WB+: a New Audio Coding Standard for 3rd Generation Mobile Audio Services", 2005 IEEE International Conference on Acoustics, Speech, and Signal Processing. Philadelphia, PA, USA., Mar. 18, 2005, 1109-1112.

Meltzer, S. et al., "SBR enhanced audio codecs for digital broadcasting such as Digital Radio Mondiale (DRM)", AES, 112th Convention, Paper 5559, Munich, May 10, 2002.

Nagel, F et al., "A Harmonic Bandwidth Extension Method for Audio Codecs", ICASSP International Conference on Acoustics, Speech and Signal Processing. IEEE CNF. Taipei, Taiwan, Apr. 19, 2009, 145-148.

Nagel, Frederik et al., "A Continuous Modulated Single Sideband Bandwidth Extension", May 1, 2010, 357-360.

Nagel, Frederik et al., "A Phase Vocoder Driven Bandwidth Extension Method with Novel Transient Handling for Audio Codecs", Audio Engineering Society Convention Paper, Presented at the 126th Convention, Munich, Germany, May 7-10, 2009, 1-8.

Villemoes, Lars et al., "Methods for Enhanced Harmonic Transposition", Oct. 16, 2011, 4 Pages.

Zhong, Haishan et al., "QMF Based Harmonic Spectral Band Replication", Audio Engineering Society Convention Paper 8517 Presented at the 131st Convention Oct. 20-23, 2011 New York, NY, USA, Oct. 20, 2011, 1-9 Pages.

Ziegler, et al., "Enhancing mp3 with SBR: Features and Capabilities of the new mp3PRO Algorithm", AES Convention Paper 5560, Presented at the 112th Convention, Munich, Germany, May 2002, 7 pages.

* cited by examiner

APPARATUS AND METHOD FOR REPRODUCING AN AUDIO SIGNAL, APPARATUS AND METHOD FOR GENERATING A CODED AUDIO SIGNAL, COMPUTER PROGRAM AND CODED AUDIO SIGNAL

CROSS-REFERENCE TO RELATED APPLICATIONS

This application is a continuation of copending International Application No. PCT/EP2013/067730, filed Aug. 27, 2013, which is incorporated herein by reference in its entirety, and additionally claims priority from U.S. patent application Ser. No. 61/693,575, filed Aug. 27, 2012, as well as European Patent Application No. 12187265, filed Oct. 4, 2012, all of which are incorporated herein by reference in their entirety.

The present invention relates to an apparatus, a method and a computer program for reproducing an audio signal and, in particular, to an apparatus, a method and a computer program for reproducing an audio signal in situations in which the available data rate is reduced. In addition, the present invention relates to an apparatus, a method and a computer program for generating a coded audio signal and a corresponding coded audio signal.

BACKGROUND OF THE INVENTION

The perceptually adapted encoding of audio signals, for efficient storage and transmission of these data rate reduced signals, has gained acceptance in many fields. Encoding algorithms are known, in particular as MPEG-1/2, layer 3 "MP3", MPEG-2/4 Advanced Audio Coding (AAC) or MPEG-H Unified Speech and Audio Coding (USAC). The underlying coding techniques, in particular when achieving lowest bit rates, lead to a reduction of the audio quality. The impairment is often mainly caused by an encoder side limitation of the audio signal bandwidth to be transmitted.

In such a situation, it is known state-of-the-art to subject the audio signal to a band limiting on the encoder side, and to encode only a lower band of the audio signal by means of a high quality audio encoder. The upper band, however, is only very coarsely characterized by a set of parameters, which convey e.g. the spectral envelope of the upper band. On the decoder side, the upper band is then synthesized by patching the decoded lower band signal into the otherwise empty upper band and performing subsequent parameter controlled adjustments.

Standard methods for a bandwidth extension of band-limited audio signals use a copying function of low-frequency signal portions (LF) into the high frequency range (HF), in order to approximate information missing due to the band limitation. In principle, such a copying function is technically equivalent to a spectral shift computed in time domain by means of single sideband (SSB) modulation, but computationally much less complex. Such methods, like Spectral Band Replication (SBR), are described in M. Dietz, L. Liljeryd, K. Kjörling and O. Kunz, "Spectral Band Replication, a novel approach in audio coding," in 112th AES Convention, Munich, May 2002; S. Meltzer, R. Böhm and F. Henn, "SBR enhanced audio codecs for digital broadcasting such as "Digital Radio Mondiale" (DRM)," 112th AES Convention, Munich, May 2002; T. Ziegler, A. Ehret, P. Ekstrand and M. Lutzky, "Enhancing mp3 with SBR: Features and Capabilities of the new mp3PRO Algorithm," in 112th AES Convention, Munich, May 2002; International Standard ISO/IEC 14496-3:2001/FPDAM 1, "Bandwidth Extension," ISO/IEC, 2002, or "Speech bandwidth extension method and apparatus", Vasu Iyengar et al. U.S. Pat. No. 5,455,888.

In these methods no harmonic transposition is performed, but successive bandpass signals of the lower band are introduced into successive filterbank channels of the upper band. By this, a coarse approximation of the upper band of the audio signal is achieved. This coarse approximation of the signal is then in a further step approximated to the original by a post processing using control information gained from the original signal. Here, e.g. scale factors serve for adapting the spectral envelope, an inverse filtering and the addition of a noise floor for adapting tonality and a supplementation by sinusoidal signal portions, as it is also described in the MPEG-4 Standard.

It is known from harmonic bandwidth extensions techniques described in Nagel, F.; Disch, S. A Harmonic Bandwidth Extension Method for Audio Codecs, IEEE Int. Conf. on Acoustics, Speech and Signal Processing (ICASSP), 2009; Nagel, F.; Disch, S.; Rettelbach, N. A Phase Vocoder Driven Bandwidth Extension Method with Novel Transient Handling for Audio Codecs, 126th AES Convention, 2009; Zhong, H.; Villemoes, L.; Ekstrand, P. et al. QMF Based Harmonic Spectral Band Replication, 131st Audio Engineering Society Convention, 2011; Villemoes, L.; Ekstrand, P.; Hedelin, P. Methods for enhanced harmonic transposition, IEEE Workshop on Applications of Signal Processing to Audio and Acoustics, (WASPAA), 2011, that in synthesizing the upper band unwanted auditory roughness might be introduced into the signal. One cause (out of many) of said roughness is spectral misalignment of the patch and/or dissonance effects in the transition regions between lower band and first patch or between consecutive patches. Harmonic bandwidth extensions techniques are designed to improve on these two aspects, albeit at the expense of computational complexity.

Filterbank calculations and patching in the filterbank domain, especially in harmonic bandwidth extension, may indeed become a high computational effort. In WO 98/57436 an advanced patching technique is described which can, to some limited extent, avoid dissonance effects by introducing so-called guard bands between different spectral patches and by performing a modified copy-up patching to lessen spectral misalignment while keeping computational complexity moderate.

Apart from this, further methods exist such as the so-called "blind bandwidth extension", described in E. Larsen, R. M. Aarts, and M. Danessis, "Efficient high-frequency bandwidth extension of music and speech", In AES 112th Convention, Munich, Germany, May 2002 wherein no information on the original HF range is used. Further, also the method of the so-called "Artificial bandwidth extension", exists which is described in K. Käyhkö, A Robust Wideband Enhancement for Narrowband Speech Signal; Research Report, Helsinki University of Technology, Laboratory of Acoustics and Audio signal Processing, 2001.

In J. Mäkinen et al.: AMR-WB+: a new audio coding standard for 3rd generation mobile audio services Broadcasts, IEEE, ICASSP '05, a method for bandwidth extension is described, wherein the copying operation of the bandwidth extension with an up-copying of successive bandpass signals according to SBR technology is replaced by mirroring, for example, by upsampling.

Further technologies for bandwidth extension are described in the following documents. R. M. Aarts, E. Larsen, and O. Ouweltjes, "A unified approach to low- and high frequency bandwidth extension", AES 115th Convention, New York, USA, October 2003; E. Larsen and R. M. Aarts, "Audio Bandwidth Extension—Application to psychoacoustics, Signal Processing and Loudspeaker Design", John Wiley & Sons, Ltd., 2004; E. Larsen, R. M. Aarts, and M. Danessis, "Efficient high-frequency bandwidth extension of music and speech", AES 112th Convention, Munich, May 2002; J. Makhoul, "Spectral Analysis of Speech by Linear Prediction", IEEE Transactions on Audio and Electroacoustics, AU-21(3), June 1973; U.S. patent application Ser. No. 08/951,029; U.S. Pat. No. 6,895,375.

Known methods of harmonic bandwidth extension show a high complexity. On the other hand, methods of complexity-reduced bandwidth extension show quality losses. In particular with a low bitrate and in combination with a low bandwidth of the LF range, artifacts such as roughness and a timbre perceived to be unpleasant may occur. A reason for this is primarily the fact that the approximated HF portion is based on one or more direct copy or mirror operations of the LF portion of the spectrum.

SUMMARY

According to an embodiment, an apparatus for reproducing an audio signal based on first data representing a coded version of a first portion of the audio signal in a first frequency band and second data representing side information on a second portion of the audio signal in a second frequency band, the second frequency band including frequencies higher than the first frequency band, may have: a first reproducer configured to reproduce the first portion of the audio signal based on the first data; a provider configured to provide a patch signal in the second frequency band, wherein the patch signal is at least partially uncorrelated with respect to the first portion of the audio signal or is at least partially a decorrelated version of the first portion of the audio signal, which has been shifted to the second frequency band; a second reproducer representing a post-processor and configured to reproduce the second portion of the audio signal in the second frequency band based on the second data and the patch signal, wherein a spectral envelope of the second portion of the audio signal, a noise floor in the second portion of the audio signal, a tonality measure for each partial band in the second portion of the audio signal, and an explicit coding of prominent sinusoidal portions in the second portion of the audio signal represent side information represented by the second data; and a combiner to combine the reproduced first portion of the audio signal and the patch signal before the second portion of the audio signal is reproduced by the second reproducer or to combine the reproduced first portion of the audio signal and the reproduced second portion of the audio signal.

According to another embodiment, a method for reproducing an audio signal based on first data representing a coded version of a first portion of the audio signal in a first frequency band and second data representing side information on a second portion of the audio signal in a second frequency band, the second frequency band including frequencies higher than the first frequency band, may have the steps of: reproducing the audio signal in the first frequency band based on the first data; providing a patch signal in the second frequency band, wherein the patch signal is at least partially uncorrelated with respect to the first portion of the audio signal or is at least partially a decorrelated version of the first portion of the audio signal, which has been shifted to the second frequency band; reproducing the second portion of the audio signal in the second frequency band based on the second data and the patch signal by means of a post-processor, wherein a spectral envelope of the second portion of the audio signal, a noise floor in the second portion of the audio signal, a tonality measure for each partial band in the second portion of the audio signal, and an explicit coding of prominent sinusoidal portions in the second portion of the audio signal represent side information represented by the second data; and combining the reproduced first portion of the audio signal and the patch signal before the second portion of the audio signal is reproduced or combining the reproduced first portion of the audio signal and the reproduced second portion of the audio signal.

According to another embodiment, an apparatus for generating a coded audio signal, the coded audio signal including first data representing a coded version of a first portion of the audio signal in a first frequency band and second data representing side information on a second portion of the audio signal in a second frequency band, the second frequency band including frequencies higher than the first frequency band, may have: a decorrelation information adder configured to add to the coded audio signal in addition to the first data and the second data information on a degree of decorrelation to be used between the first portion of the audio signal and a patch signal based on which the second portion of the audio signal is reproduced by means of a post-processor when reproducing the audio signal from the coded audio signal, wherein a spectral envelope of the second portion of the audio signal, a noise floor in the second portion of the audio signal, a tonality measure for each partial band in the second portion of the audio signal, and an explicit coding of prominent sinusoidal portions in the second portion of the audio signal represent side information represented by the second data.

According to another embodiment, a method for generating a coded audio signal, the coded audio signal including first data representing a coded version of a first portion of the audio signal in a first frequency band and second data representing side information on a second portion of the audio signal in a second frequency band, the second frequency band including frequencies higher than the first frequency band, may have the steps of: adding to the coded audio signal in addition to the first data and the second data information on a degree of decorrelation to be used between the first portion of the audio signal and a patch signal based on which the second portion of the audio signal is reproduced by means of a post-processor when reproducing the audio signal from the coded audio signal, wherein a spectral envelope of the second portion of the audio signal, a noise floor in the second portion of the audio signal, a tonality measure for each partial band in the second portion of the audio signal, and an explicit coding of prominent sinusoidal portions in the second portion of the audio signal represent side information represented by the second data.

According to another embodiment, a computer program may have a program code for performing a method according to claim 11 when the computer program runs on a computer.

According to another embodiment, a computer program may have a program code for performing a method according to claim 13 when the computer program runs on a computer.

Embodiments of the invention relate to a reproduction of an audio signal providing for a bandwidth extension using decorrelated sub-band audio signals. In contrast to already existing methods, most of the signal distortions and artifacts, which currently are typical for bandwidth extensions, may be avoided by using decorrelated sub-band audio signals for bandwidth extension, rather than correlated (copied-up or mirrored) sub-band audio signals. This is achieved by providing the audio signal, which forms the basis for a reproduction of a high-frequency portion of the audio signal, uncorrelated or decorrelated with respect to the first portion (LF portion) of the audio signal. Embodiments of the invention are based on the recognition that the correlation between the low frequency portion and the high frequency portion need not be maintained when reproducing the second signal portion of the audio signal. Rather, the inventors recognized that artifacts, such as roughness and a timbre perceived to be unpleasant may be avoided by making use of a decorrelated or completely uncorrelated patch signal.

Embodiments of the invention provide for a coded audio signal comprising:

first data representing a coded version of a first portion of the audio signal in a first frequency band;

second data representing side information on a second portion of the audio signal in a second frequency band, the second frequency band comprising frequencies higher than the first frequency band; and information on a degree of decorrelation to be used between the first portion of the audio signal and a patch signal based on which the second portion of the audio signal is reproduced when reproducing the audio signal from the coded audio signal.

Thus, embodiments of the invention permit for generating a coded audio signal in a manner which permits for decoding the coded audio signal in an appropriate manner using an appropriate degree of decorrelation. The appropriate degree of decorrelation may be determined at the encoder side based on properties of the first portion and/or the second portion of the audio signal.

BRIEF DESCRIPTION OF THE DRAWINGS

Embodiments of the present invention will be detailed subsequently referring to the appended drawings, in which.

DETAILED DESCRIPTION OF THE INVENTION

Prior to explaining embodiments of the invention in detail, it is regarded worthwhile shortly discussing theoretical thoughts underlying the invention.

As explained above, bandwidth extensions based on copy operations (or mirror operations), such as for example SBR (SBR=spectral band replication), copy large parts of an LF spectrum directly into the HF range.

Figure 6:
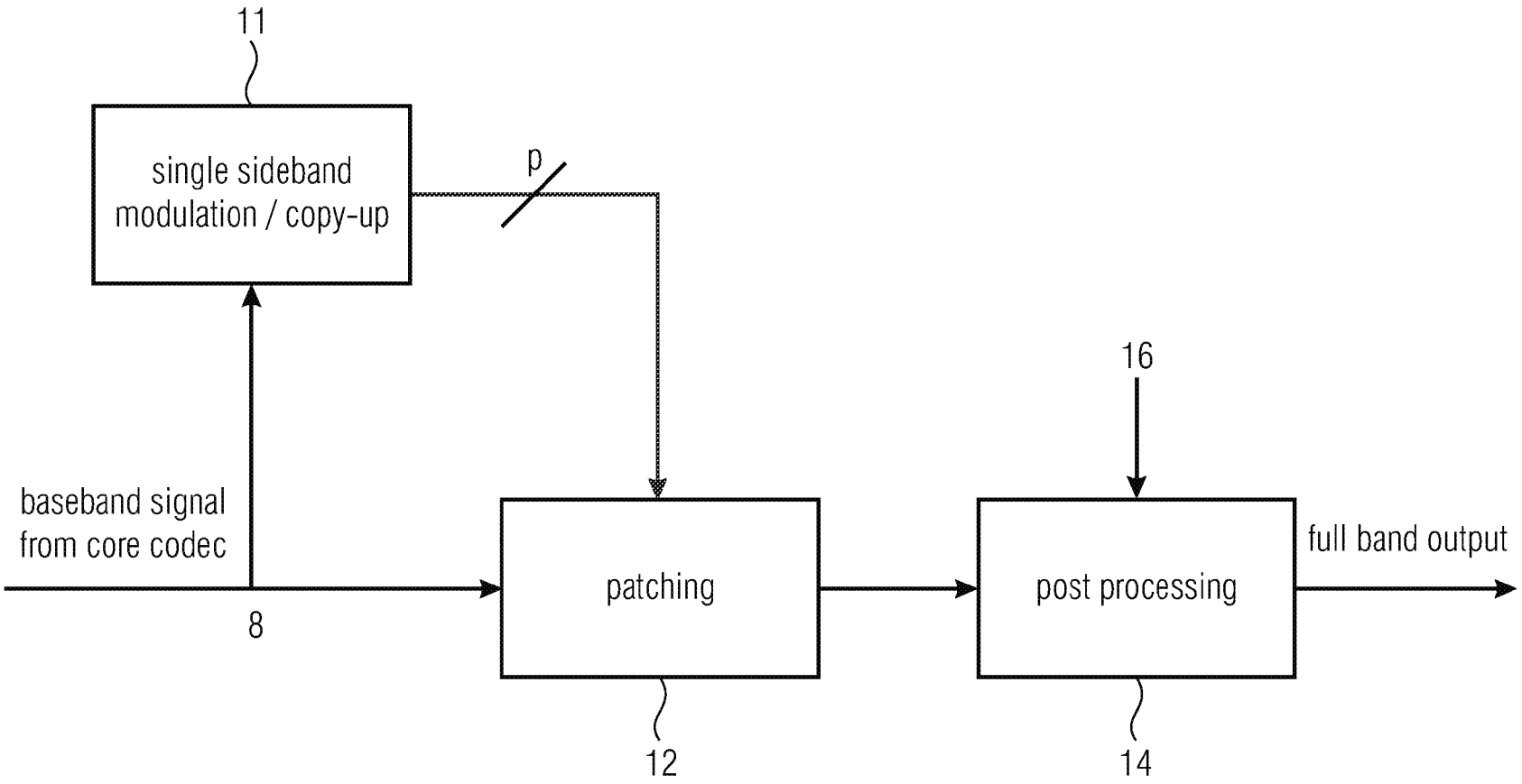
FIG. 6 shows a block diagram of an apparatus for reproducing an audio signal from which the invention starts.

An example of an SBR apparatus is described referring to FIGS. 6 and 7. The envelope of an audio signal 2 is shown in FIG. 7*a*. Audio signal 2 comprises a low-frequency portion (or low-frequency band) 4 and a high-frequency portion (or high-frequency band) 6. Typically, in perceptual coding of audio signals, the low-frequency portion 4 is coded by means of a high quality audio encoder, such as a PCM encoder (PCM=pulse code modulation), while the upper band is only very coarsely characterized by side information. Data representing the coded low-frequency portion and data representing the side information are transmitted using a corresponding core codec. FIG. 6 shows a baseband signal 8 from a core codec, which represents the low-frequency portion 4 shown in FIG. 7*b*. This signal 8 is applied to a single sideband modulation/copy-up unit, in which signal 8 is shifted to the frequency range of the high-frequency portion 6. This shifted signal is shown as signal 10 in FIG. 7*c*. Shifted signal 10 and signal 8 are applied to a patching unit 12, in which both signals are combined (added) to obtain the spectrum shown in FIG. 7*c*. The signal portion 8 may be shifted into p different higher frequency ranges, wherein $p \geq 1$. Thus, a combination of one or more (p) shifted signals and signal 8 may take place in patching unit 12.

Figure 7A:
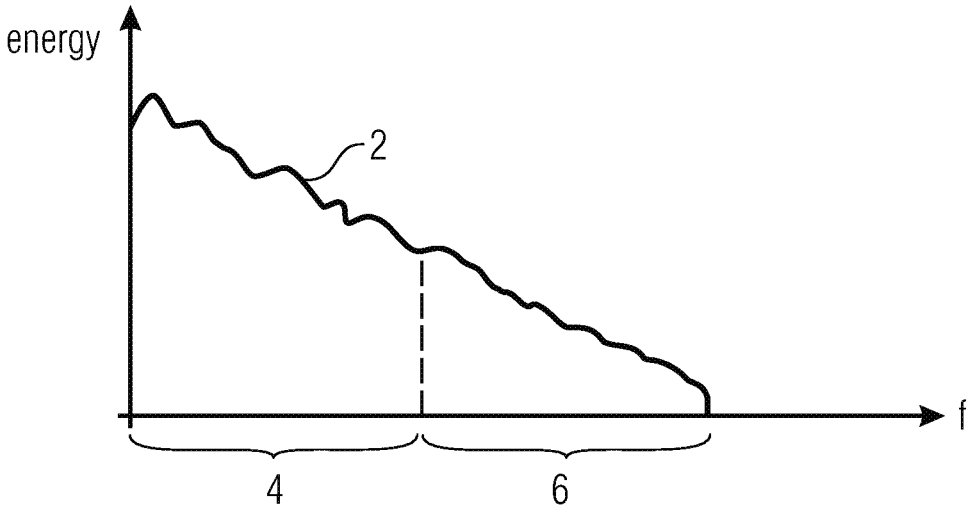
FIGS. 7*a* to 7*d* show signal diagrams useful in explaining the operation of the apparatus shown in FIG. 6.

The output signal of patching unit 12 is applied to a post-processing unit 14, which also receives side information 16 representing the audio signal in the high-frequency portion 6. Thus, the high frequency portion 10' of the audio signal 6 is reproduced based on the side information 16 and the audio signal of the low-frequency portion 4. The resulting audio signal is shown in FIG. 7*d*. Post-processing unit 14 outputs the full band output covering the frequency ranges of the low-frequency portion 4 and the high-frequency portion 6.

Accordingly, bandwidth extensions based on copy operations (or mirror operations), such as for example SBR, copy large parts of a low-frequency spectrum directly into the high-frequency range. This may be achieved by employing a single-sideband modulation of the time-domain representation of the audio signal or by a direct copy process (copy-up) in the spectral representation of the audio signal. This processing step is usually called "patching".

Generally, there may be a plurality of patches copied into different high frequency bands. The respective frequency bands may overlap or not. Each of the corresponding HF patches thus is completely correlated to the low-frequency range from which it has been extracted. The inventors recognized that, thereby, temporal envelope modulations may occur by superimposing both signals with a frequency that depends on the spectral distance between the LF band and the spectral location of the respective HF patch.

From a system-theoretical point of view, this phenomenon is to be regarded as dual to the operation of a finite impulse response (FIR) comb filter comprising a delay of n samples with Fs as sample frequency. This filter has a magnitude frequency response with a comb width (spectral distance between two maxima of the magnitude frequency response) of 1/n*Fs. Thereby, the system-theoretical duality has the following direct correspondences:

time delay $\Leftrightarrow$ frequency translation magnitude frequency response $\Leftrightarrow$ temporal envelope.

Figure 5A:
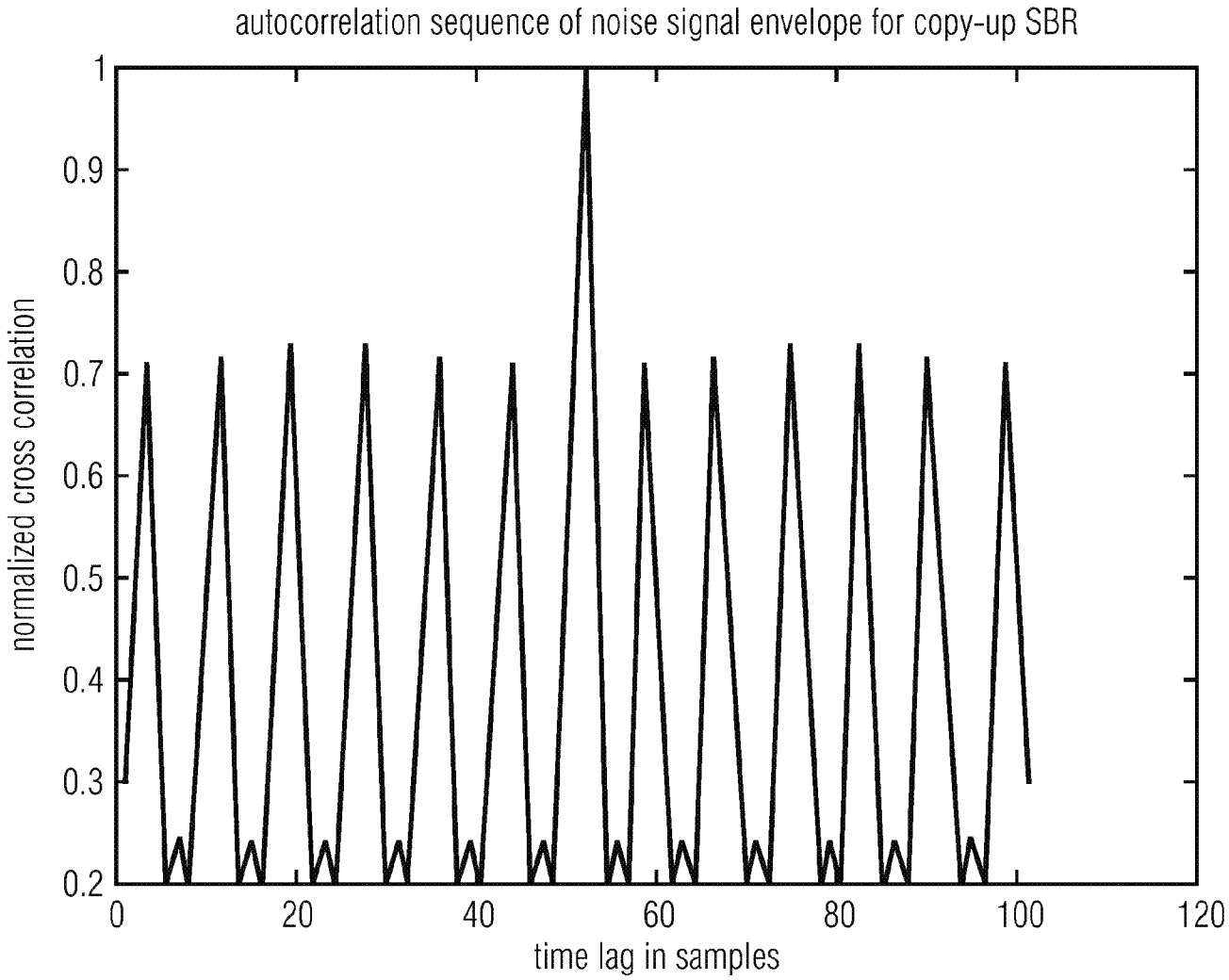
FIGS. 5*a* and 5*b* show diagrams illustrating advantages of embodiments of the invention.

The inventors recognized that the temporal modulations resulting therefrom are audible in a disturbing manner and can be made visible in the autocorrelation function of the waveform magnitude in the form of periodically repeating side maxima. Such periodically repeating side maxima in the autocorrelation sequence of a noise signal envelope for copy-up SBR are shown in FIG. 5*a*. FIG. 5*a* shows the autocorrelation function of the magnitude envelope of white noise, wherein the bandwidth is extended with three direct copy-up patches, which are fully correlated among each other and with the LF band.

Only when the LF and the HF signal show the same amplitude, a maximum modulation depth is achieved. In practice, the modulation effect therefore is often slightly lower, because typically the HF range is markedly quieter (less loud)

than the LF range. Noise-like signals or quasi-stationary signals with a pronounced overtone structure are to be regarded as particularly critical with respect to the modulation artifacts.

For the presence of several patches (p in FIG. 6) that are entirely correlated among each other, the above-mentioned duality is valid as well, of course. A temporal modulation of the magnitude envelope appears that is dual to the magnitude frequency response of a corresponding FIR filter.

Thus, according to embodiments of the invention, the patch or the patches are decorrelated from each other and from the LF band. In embodiments of the invention, one or more decorrelators are used that decorrelate the signal derived from the low-frequency signal components, respectively, before it is inserted into the higher frequency range(s) and, as the case may be, post-processed.

Embodiments of the invention avoid the explained problems that occur due to a copy operation or a mirror operation by using mutually decorrelated patches. In embodiments of the invention, the respective HF patches are decorrelated from the LF band in an individual manner using decorrelators, for example by means of all-pass filters or other known decorrelation methods, or to create the patches synthetically in a naturally decorrelated manner right away.

In embodiments of the invention, the degree of decorrelation can be fixedly determined or adjusted at the decoder-side, or it may be transmitted as a parameter from the encoder to the decoder. Furthermore, the entire patch may be decorrelated, or only specific portions of the patch. The portions of the patch to be decorrelated by also be transmitted as a parameter from the encoder to the decoder as part of the corresponding information added to the coded audio signal.

The inventive approach is beneficial when compared to conventional approaches for bandwidth extension since distortions and sound colorations by disturbing or parasitic envelope modulations, as they exist with current methods based on single-sideband modulation/copy-up of the LF band, are inherently avoided with the inventive approach. This is achieved by using HF patches that are decorrelated versions of the LF signal portion or that are completely uncorrelated with respect to the LF signal portion.

A scenario in which embodiments of the invention may be implemented is now described with reference to FIGS. 4*a* and 4*b*.

Figure 4A:
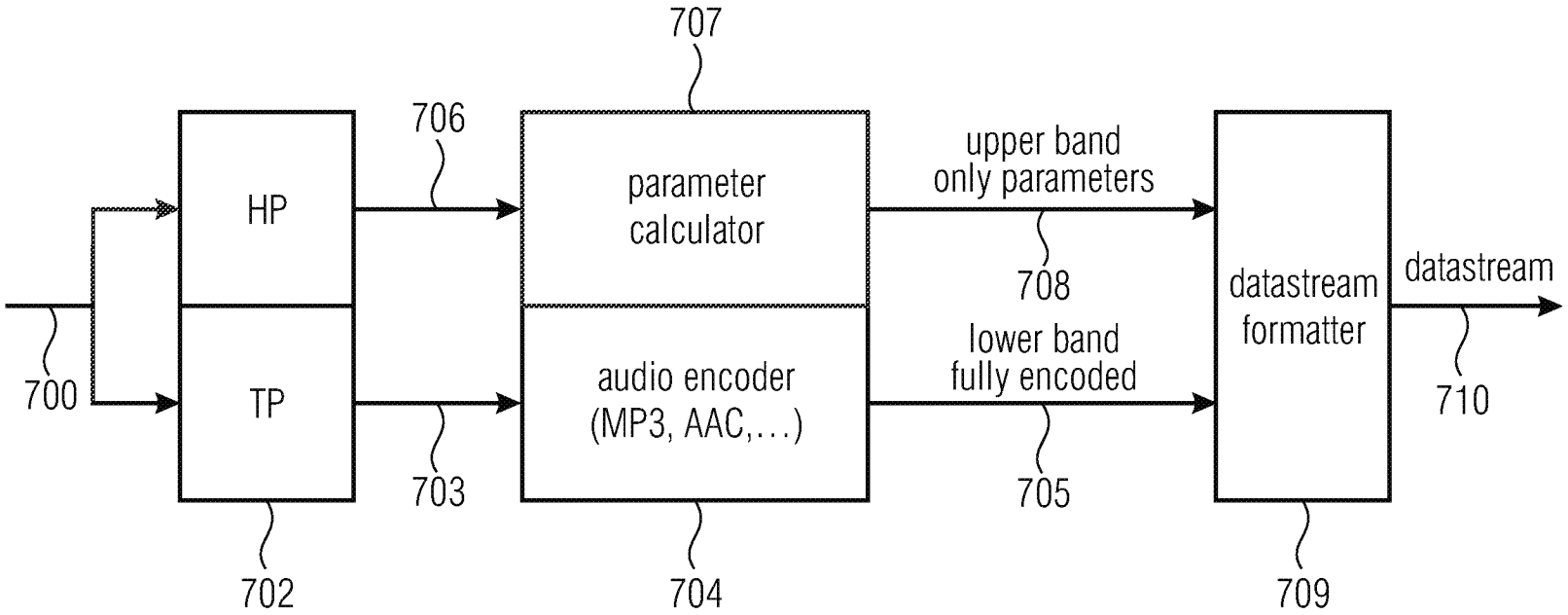
FIG. 4*a* shows a schematical illustration of an encoder side in the context of embodiments of the invention.
Figure 4B:
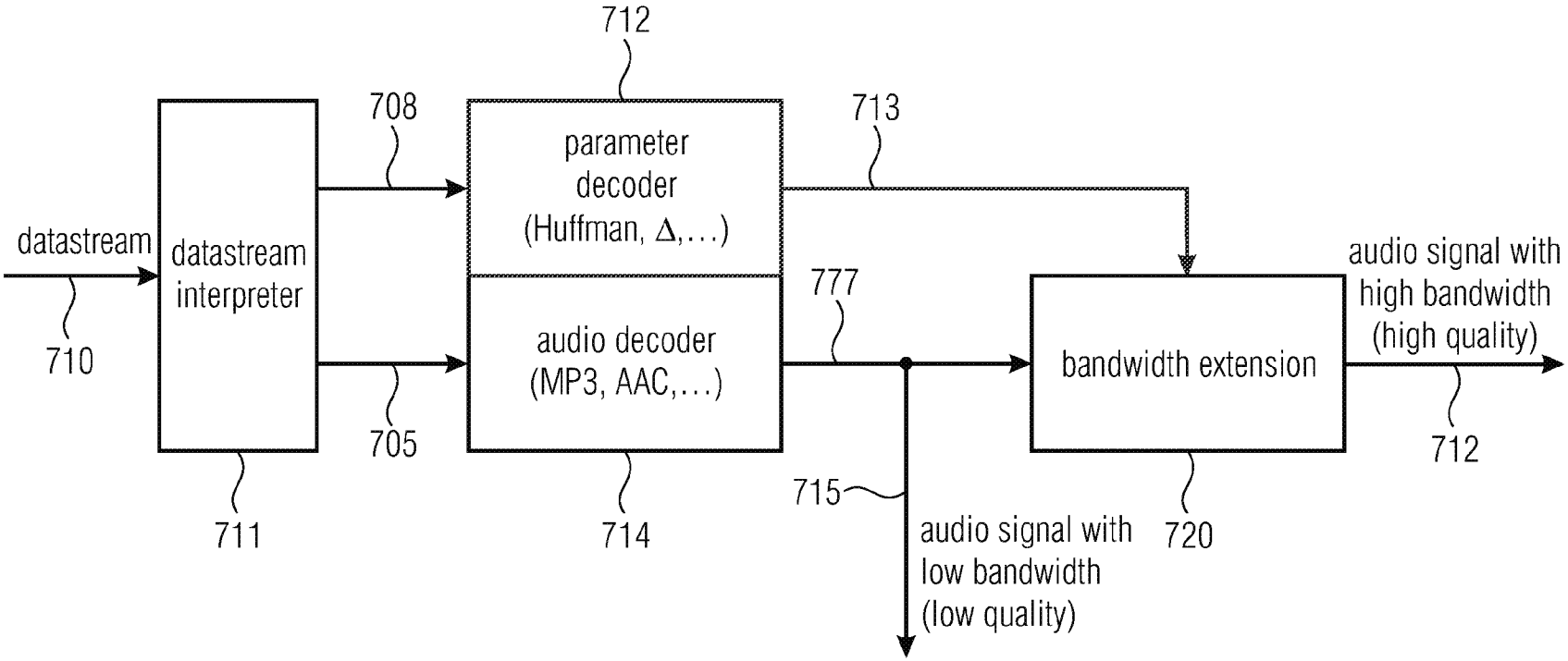
FIG. 4*b* shows a schematical illustration of a decoder-side in the context of embodiments of the invention.

An encoder side is shown in FIG. 4*a* and a decoder side is shown in FIG. 4*b*. An audio signal is fed into a lowpass/highpass combination at an input 700. The lowpass/highpass combination on the one hand includes a lowpass (LP), to generate a lowpass filtered version of the audio signal, illustrated at 703 in FIG. 7*a*. This lowpass filtered audio signal is encoded with an audio encoder 704. The audio encoder is, for example, an MP3 encoder (MPEG-1/2 layer 3) or an AAC encoder, described in the MPEG-2/4 standard. Alternative audio encoders providing a transparent or advantageously perceptually transparent representation of the band-limited audio signal 703 may be used in the encoder 704 to generate a completely encoded or perceptually encoded and perceptually transparently encoded audio signal 705, respectively. The upper band of the audio signal is output at an output 706 by the highpass portion of the filter 702, designated by "HP". The highpass portion of the audio signal, i.e. the upper band or HF band, also designated as the HF portion, is supplied to a parameter calculator 707 which is implemented to calculate the different parameters (representing side information representing the high frequency portion of the audio signal). These parameters are, for example, the spectral envelope of the upper band 706 in a relatively coarse resolution, for example, by representation of a scale factor for each frequency group on a perceptually adapted scale (critical bands) e.g. for each Bark band on the Bark scale. A further parameter which may be calculated by the parameter calculator 707 is the noise floor in the upper band, whose energy per band may be related to the energy of the envelope in this band. Further parameters which may be calculated by the parameter calculator 707 include a tonality measure for each partial band of the upper band which indicates how the spectral energy is distributed in a band, i.e. whether the spectral energy in the band is distributed relatively uniformly, wherein then a non-tonal signal exists in this band, or whether the energy in this band is relatively strongly concentrated at a certain location in the band, wherein then rather a tonal signal exists for this band. Further parameters consist in explicitly encoding peaks relatively strongly protruding in the upper band with regard to their height and their frequency, as the bandwidth extension concept, in the reconstruction without such an explicit encoding of prominent sinusoidal portions in the upper band, will only recover the same very rudimentarily, or not at all.

In any case, the parameter calculator 707 is implemented to generate only parameters 708 for the upper band which may be subjected to similar entropy reduction steps as they may also be performed in the audio encoder 704 for quantized spectral values, such as for example differential encoding, prediction or Huffman encoding, etc. The parameter representation 708 and the audio signal 705 are then supplied to a datastream formatter 709 which is implemented to provide an output side datastream 710 which will typically be a bitstream according to a certain format as it is for example normalized in the MPEG4 Standard.

Figure 7B:
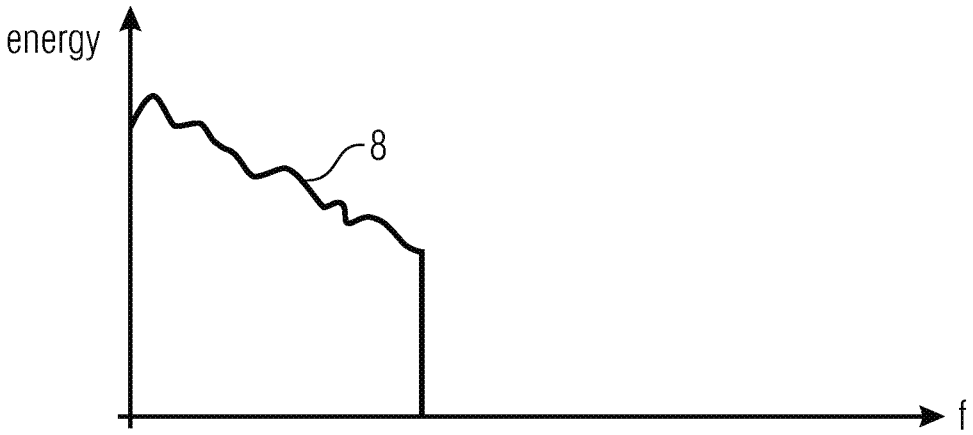
Figure 7C:
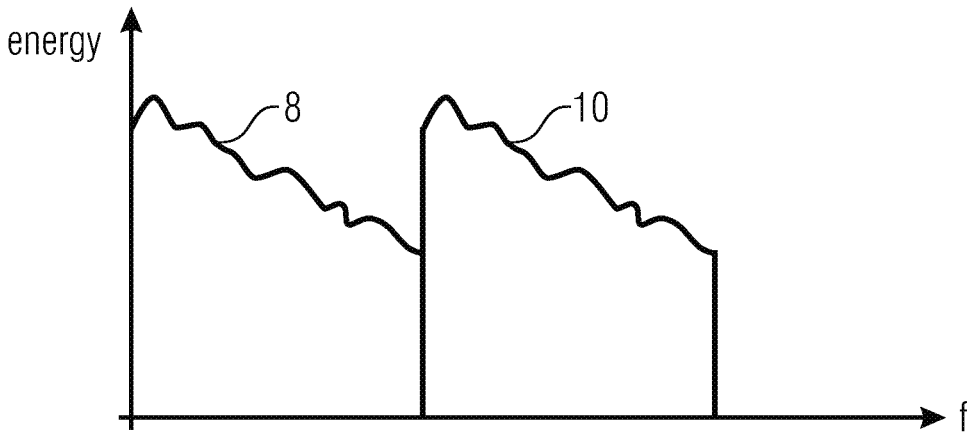
Figure 7D:
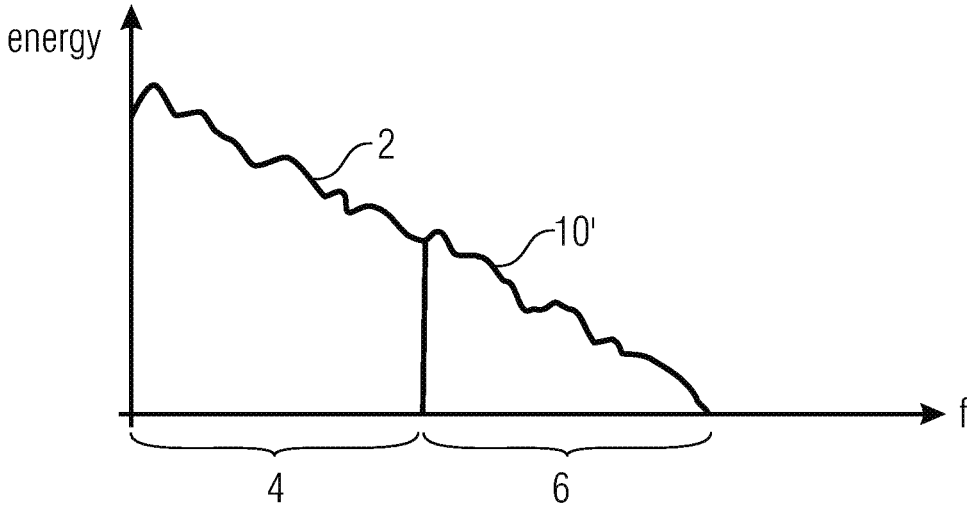

The decoder side, as it may be suitable for the present invention, is shown in FIG. 7*b*. The datastream 710 enters a datastream interpreter 711 which is implemented to separate the parameter portion 708 from the audio signal portion 705. The parameter portion 708 is decoded by a parameter decoder 712 to obtain decoded parameters 713. In parallel to this, the audio signal portion 705 is decoded by an audio decoder 714 to obtain the audio signal 777 which was illustrated at 8 in FIG. 6, for example.

Depending on the implementation, audio signal 777 may be output via a first output 715. At the output 715, an audio signal with a small bandwidth and thus also a low quality may then be obtained. For a quality improvement, however, bandwidth extension 720 may be performed making use of the inventive approach as described in the following referring to FIGS. 1*a*, 1*b* and 2 to obtain the audio signal 112 on the output side with an extended or high bandwidth, respectively, and a high quality.

Figure 1A:
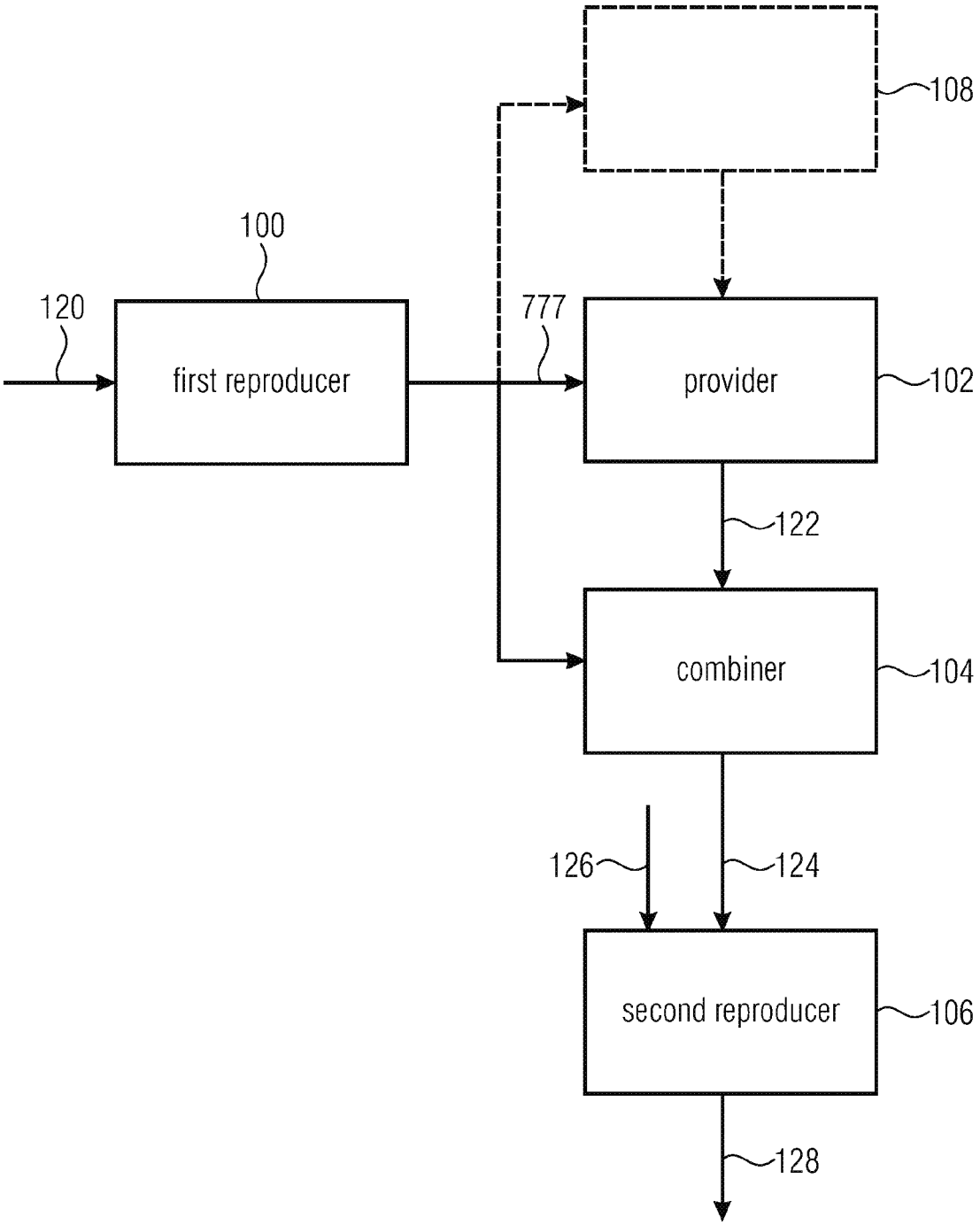
FIG. 1*a* shows a block diagram of an embodiment of an apparatus for reproducing an audio signal.

One embodiment of an inventive apparatus for reproducing an audio signal and, thereby extending the bandwidth thereof, is shown in FIG. 1*a*. The apparatus comprises a first reproducer 100, a provider 102, a combiner 104 and a second reproducer 106. Optionally, a transition detector 108 may be provided. The first reproducer 100 receives at an input thereof first data 120 representing a coded version of a first portion of audio data in a first frequency band. For example, the first data 120 may correspond to audio signal portion 705 shown in FIG. 4*b*. The first reproducer 100 reproduces the audio signal in the first frequency band based on the first data 120. For example, the first reproducer 100 may be formed by the audio decoder 714 shown in FIG. 4*b*. The first reproducer 110 outputs the audio signal in the first frequency band, which may correspond to audio signal 777 shown in FIG. 4*b*. Audio signal 777 is applied to provider 102, which provides for a patch signal 122 in the second frequency band. The patch signal 122 is at least partially uncorrelated with respect to the first portion of the audio signal 777 or is at least partially a decorrelated version of the first portion of the audio signal, which has been shifted to the second frequency band. The audio signal 777 and the patch signal 122 are combined, such as added, in combiner 104. The combined signal 124 is output and applied to the second reproducer 106. The second reproducer 106 receives the combined signal 124 and second data 126 representing side information on a second portion of the audio signal in a second frequency band. For example, the second data 126 may correspond to decoded parameters 713 described above with respect to FIG. 4*b*. The second reproducer 106 reproduces the audio signal in the second frequency band based on the patch signal (within the combined signal 124) and based on the second data 126.

In embodiments of the invention, the first frequency band may correspond to the frequency range associated with the first portion of the audio signal shown in FIG. 7*a*, and the second frequency band may correspond to the frequency range associated with the second portion of the audio signal shown in FIG. 7*a*.

According to the embodiment shown in FIG. 1*a*, the second reproducer 106 outputs a reproduced audio signal 128 with a high bandwidth.

Figure 1B:
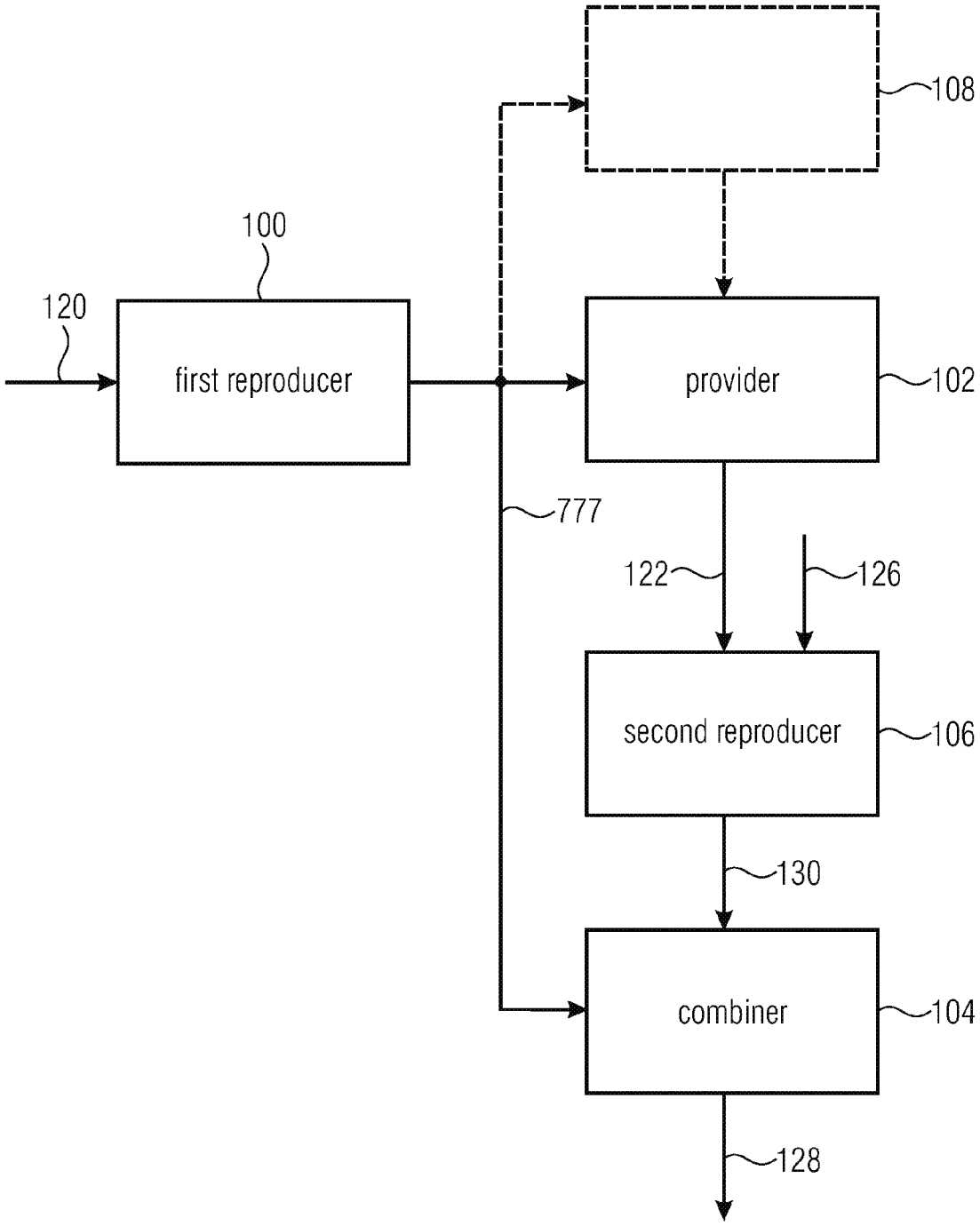
FIG. 1*b* shows a block diagram of another embodiment of an apparatus for reproducing an audio signal.

In the alternative embodiment shown in FIG. 1*b*, the output of provider 102 is coupled to the second reproducer 106 and the output of second reproducer 106 is coupled to combiner 104. Thus, according to the embodiment shown in FIG. 1*b*, an audio signal 130 in the second frequency band is reproduced from the patch signal provided by provider 102 prior to combining the patch signal with the first portion 777 of the audio signal. Again, the second reproducer reproduces the audio signal 130 in the second frequency band based on the second data 126 and the patch signal 122. According to the embodiment shown in FIG. 1*b*, the combiner 104 outputs the reproduced audio signal 128.

In embodiments of the invention, the provider comprises a shifting unit and a decorrelator, which are configured to generate the patch signal as a decorrelated version of the first portion of the audio signal shifted to the second frequency band. In embodiments of the invention, the provider is configured to provide a synthetic patch signal which is uncorrelated with respect to the first portion of the audio signal. In embodiments of the invention, the provider is configured to provide a plurality of patch signals for a plurality of higher frequency bands. In such embodiments the second reproducer and the second combiner are adapted to reproduce a plurality of second signal portions and to combine the plurality of signal portions into the reproduced audio signal.

Figure 2:
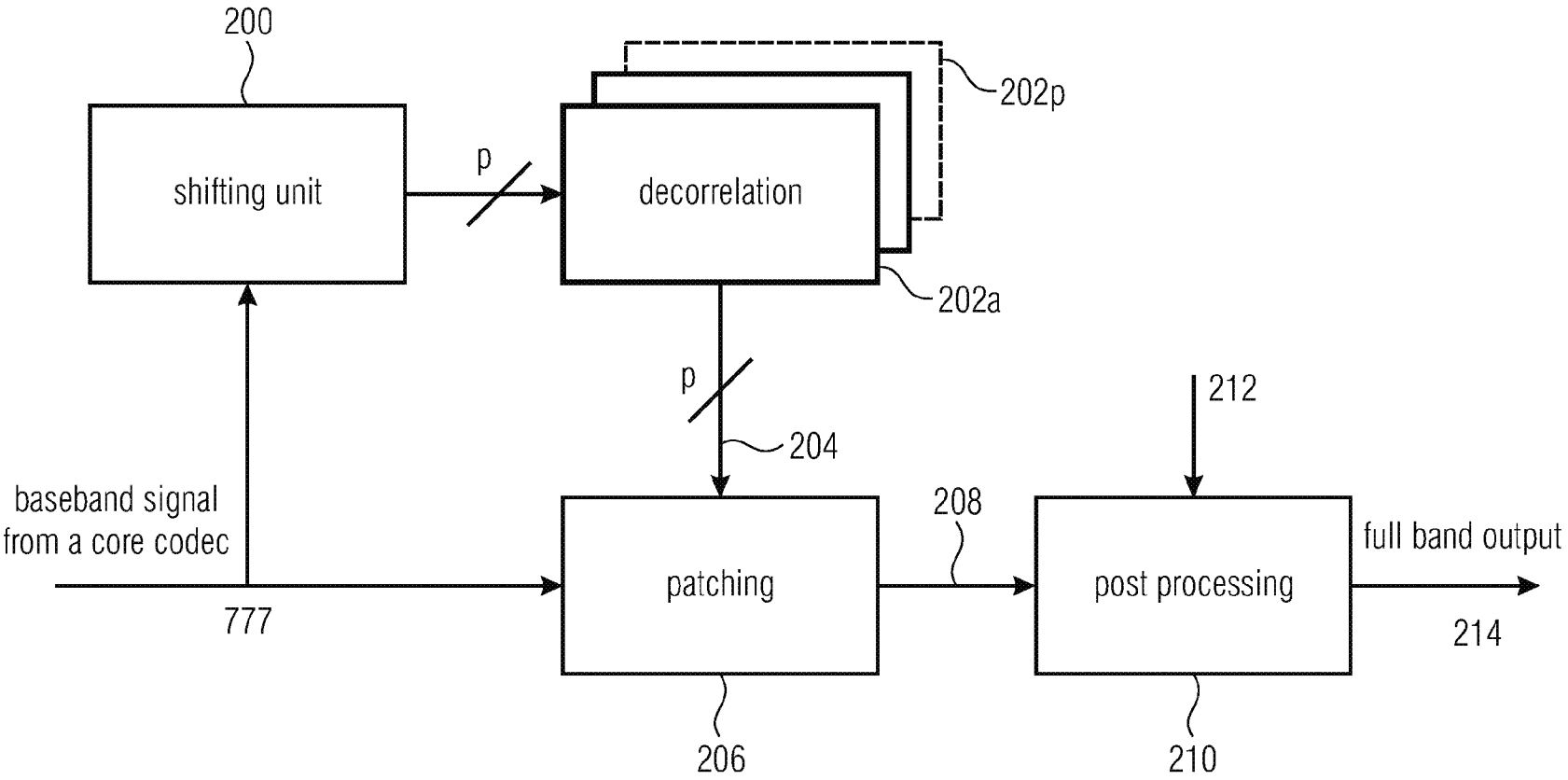
FIG. 2 shows a block diagram of a further embodiment of an apparatus for reproducing an audio signal.

An embodiment of an apparatus for reproducing an audio signal using bandwidth extension, which uses decorrelated sub-band audio signals, is shown in FIG. 2. The apparatus receives a baseband signal from the core codec, which may be signal 777 shown in FIG. 4*b*. Signal 777 is applied to a shifting unit 200. Shifting unit 200 is configured to shift signal 777 from the low-frequency range to a high-frequency range, such as from a frequency range associated with the low-frequency portion 4 in FIG. 7*a* to the frequency range associated with the high-frequency portion 6 in FIG. 7*a*.

Shifting unit 200 may be configured to simply copy-up signal portion 777 to the high-frequency range in the frequency domain. Alternatively, shifting unit 200 may be implemented as a single sideband modulation unit configured to perform a single sideband modulation in the time domain in order to shift the first portion of the audio signal from the first frequency band to the second frequency band.

The shifted first portion of the audio signal is applied to a decorrelation unit 202*a*. The shifted decorrelated first portion of the audio signal is output by the decorrelation unit 202*a* as a patch signal 204. The patch signal 204 is applied to a patching unit 206, in which the patch signal 204 is combined with the first portion 777 of the audio signal. For example, the patch signal and the first portion of the audio signal are concatenated or added in patching unit 206. The combined signal is output from patching unit 206 and applied to a post-processing unit 210.

Post-processing unit 210 receives second data 212 and represents a second reproducer configured to reproduce the second portion of the audio signal in a second frequency band based on the second data 212 and the patch signal 204 (which is included in the combined signal 208). Again, the second data 212 represent side information and may correspond to decoded parameters 713 explained above with respect to FIG. 4*b*. A fullband output 214 of post-processing unit 210 represents the reproduced audio signal.

In the embodiment shown in FIG. 2, shifting unit 200 and decorrelation unit 202*a* represent a provider configured to provide a patch signal 204.

In embodiments of the invention, shifting unit 200 may be configured to shift the first portion 777 of the audio signal into a plurality of p different frequency bands. A decorrelation unit 202*a*-202*p* may be provided for each shifted version in order to provide for p patch signals. In case more than one patch is used, (such as p patches), the p patches should be uncorrelated among each other and the LF band. Then, the shifted versions associated with each frequency band are combined within patching unit 206. Second data representing side information for each of the higher frequency bands may be provided to the post-processing unit 210 so that a plurality of higher frequency portions of the audio signal are reproduced in post-processing unit 210.

In embodiments of the invention, the first and second frequency bands (and the optionally further frequency bands) may overlap or may not overlap in the frequency direction.

Accordingly, in embodiments of the invention, the provider comprises a shifter unit configured to shift a first portion of an audio signal in a first frequency band to a second frequency band or to a plurality of different second frequency bands, and a decorrelator for decorrelating the shifted version of the first portion of the audio signal from the first portion of the audio signal. In embodiments of the invention, the decorrelator may have the same properties as known for example from spatial audio coding decorrelation. In the embodiments of the invention, the decorrelator may provide a sufficient decorrelation in order to avoid the signal distortions and artifacts which are typical for conventional bandwidth extensions using spectral band replication. The decorrelator may provide for a preservation of the spectral envelope of the first portion of the audio signal and/or may provide for a preservation of the temporal envelope, i.e. the transients, of the first portion of the audio signal. Designing an appropriate decorrelator thus might typically involve a trade-off to be made between transient preservation and decorrelation.

In embodiments of the invention, the decorrelator may be implemented as an IIR (IIR=infinite impulse response) filter in time domain or sub-band time domain, e.g. an all-pass filter, in which decorrelation is achieved via group-delay variations. In embodiments of the invention, the decorrelator may be configured to provide for phase randomization of spectral coefficients in a complex (oversampled) transform/filterbank representation (DFT, QMF representation) (DFT=discrete Fourier Transform; QMF=quadrature mirror filter). In embodiments of the invention, the decorrelator may be configured in order to provide for an application of a frequency-dependent time delay in a filterbank representation.

Embodiments of the invention may comprise a signal adaptive decorrelator that varies the degree of decorrelation in order to preserve transients. A high decorrelation may be provided for quasi-stationary signals, and a low decorrelation may be provided for transient signals. Accordingly, in embodiments of the invention, the provider for providing the patch signal may be switchable between different degrees of decorrelation.

In embodiments, the provider for providing the patch signal may be switchable between different degrees of decorrelation depending on whether the first signal portion comprises an indicator for a strong correlation between the first portion of the audio signal and the second portion of audio signal. Embodiments for such an indicator are a transient in the first portion of the audio signal, voiced speech consisting of pulse trains in the first portion of the audio signal and/or the sound of brass instruments in the first portion of the audio signal. In the following, embodiments are described, in which the indicator is a transient in the first portion of the audio signal.

In embodiments of the invention, the apparatus may comprise a detector configured to detect whether the first portion of the audio signal comprises a transient. Such a detector 108 is schematically shown in FIGS. 1*a* and 1*b*. Depending on the output signal of detector 108, provider 102 may be configured to provide the patch signal with a high decorrelation for quasi-stationary signals, i.e. when the first portion of the audio signal does not have a transient), and a low decorrelation if the first portion of the audio signal has transient signals.

In alternative embodiments of the invention, the apparatus may comprise a signal adaptive decorrelator that is activated for quasi-stationary signals and deactivated for transient signal portions. In other words, the provider may be configured to output the shifted first signal portion without decorrelation thereof in case the first signal portion comprises transient signal portions and to output the decorrelated patch signal only in case the first signal portion does not comprise transients or transient signal portions. In such embodiments, the second reproducer is configured to reproduce the audio signal in the second frequency band based on the second data and the patch signal if the first portion of the audio signal does not comprise a transient and is configured to reproduce the audio signal in a second frequency band based on the second data and a version of the first portion of the audio signal, which has been shifted to the second frequency band and which has not been decorrelated, if the first portion of the audio signal comprises a transient.

A transient or transient portions may be regarded as consisting in the fact that the audio signal changes a lot in total, i.e. that e.g. the energy of the audio signal changes by more than 50% from one temporal portion to the next temporal portion, i.e. increases or decreases. The 50% threshold is only an example, however, and it may also be smaller or greater values. Alternatively, for a transient detection, the change of energy distribution may also be considered, e.g. in the transition from a vocal to a sibilant.

In embodiments of the invention, the provider may be configured to provide a synthetic patch signal which is uncorrelated with respect to the first portion of the audio signal. In other words, patching with an uncorrelated synthetic patch signal (such as synthetic noise) might already be sufficient if parametric post-processing is fine granular (high bit-rate codec scenario) or if the signal's HF band is noisy-like anyway.

In embodiments of the invention, a correlation of the LF band and the HF band within a bandwidth extension (like SBR) is nevertheless helpful for enhancing a too coarse time grid of parametric post-processing (e.g. due to a low bit-rate codec scenario), an accurate reproduction of transients, and a preservation of tones that have a rich overtone structure (usually, tonality is not affected by decorrelation and thus the preservation of tonality does not pose a problem in designing a decorrelator).

As far as decorrelators known e.g. from spatial audio coding decorrelation are concerned, reference is made to WO 2007/118583 A1, for example.

Figure 3:
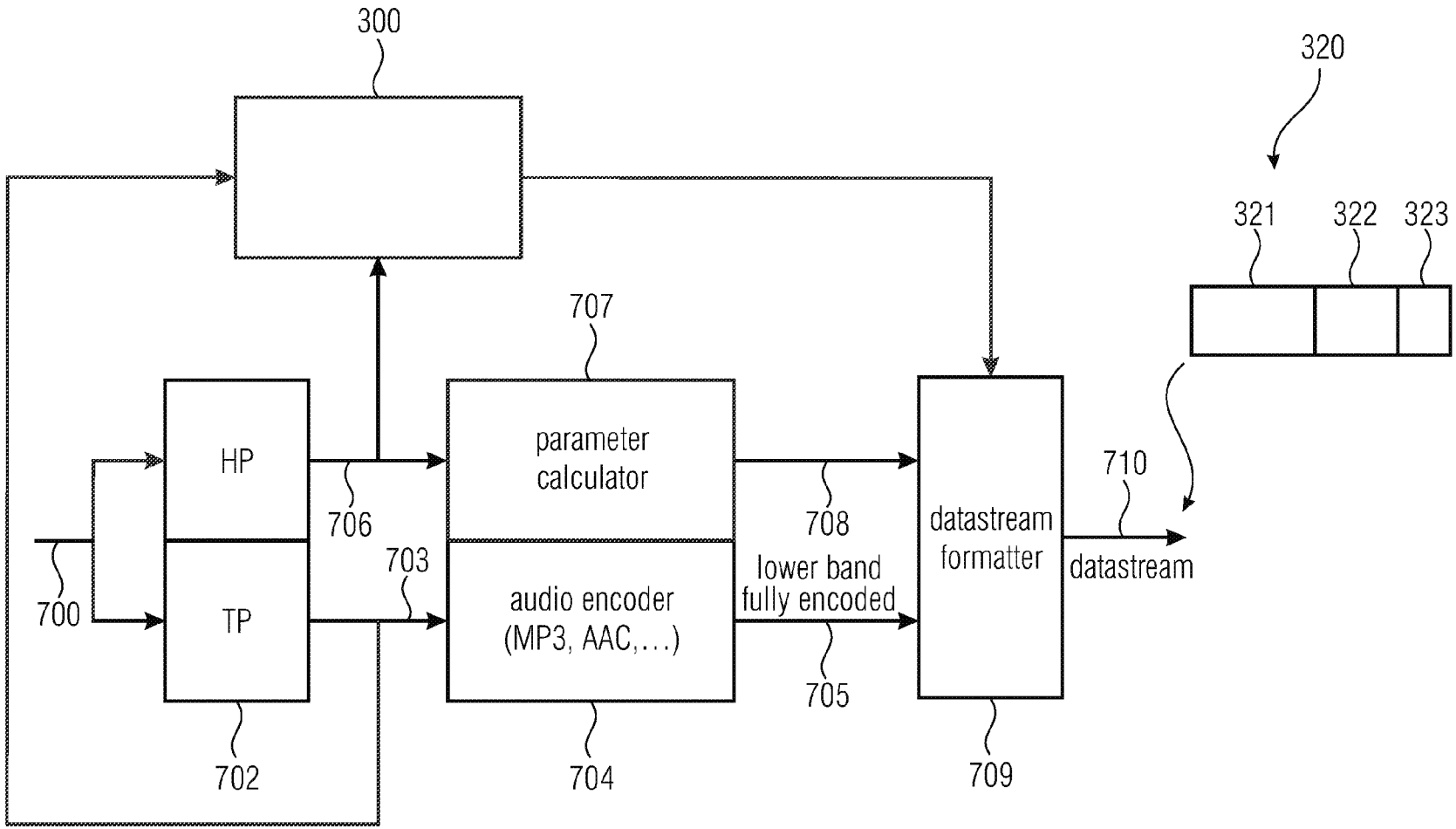
FIG. 3 shows a block diagram of an embodiment of an apparatus for generating a coded audio signal.

In embodiments of the invention, provider 102 may comprise an adaptive decorrelator, which adjusts decorrelation of the HF patches based on a parameter transmitted from an encoder to the decoder. In such embodiments, the apparatus is configured for reproducing an audio signal based on the first data, the second data and third data comprising information on a degree of decorrelation to be used between the first portion of the audio signal and a patch signal based on which the second portion is reproduced when reproducing the audio signal from the coded audio signal. Such third data may be added to coded audio data on the encoder side, such as by a decorrelation information adder 300 shown in FIG. 3 of the present application. The apparatus shown in FIG. 3 corresponds to the apparatus shown in FIG. 4*a* except for the decorrelation information adder.

The decorrelation information adder 300 receives the output of low-pass filter 702 and may detect properties from the output signal of low-pass filter 702. For example, decorrelation information adder may detect transients in the output signal of the low-pass filter 702. Depending on the properties of the output of low-pass filter 702, decorrelation information adder adds to the coded audio signal 710 information on a degree of decorrelation to be used between the first portion of the audio signal and a patch signal based on which the second portion is reproduced when reproducing the audio signal from the coded audio signal. For example, the decorrelation information may instruct the provider at the decoder-side to perform a low decorrelation or not any decorrelation at all in case there are transient portions in the low-frequency portion of the audio signal.

In embodiments of the invention, the decorrelation information adder may also receive the high-frequency portion 706 of the audio signal and may be configured to derive properties therefrom. For example, in case the decorrelation information adder detects that the HF band is noise-like, it may advise the provider on the decoder-side to provide the patch signal based on a synthetic noise signal.

In such embodiments, the coded audio signal 320 represented by data stream 710 comprises first data 321 representing a coded version of a first portion of an audio signal, second data 322 representing side information on a second portion of the audio signal in a second frequency band, and information 323 on a degree of decorrelation to be used between the first portion of the audio signal and a patch signal based on which the second portion is reproduced when reproducing the audio signal from the coded audio signal.

Accordingly, embodiments of the invention provide for an improved approach for reproducing an audio signal, i.e. for a decoder-side extension of the audio signal bandwidth. In other embodiments, the invention provides for an apparatus for generating a coded audio signal. In even other embodiments, the invention relates to such coded audio signals.

Figure 5B:
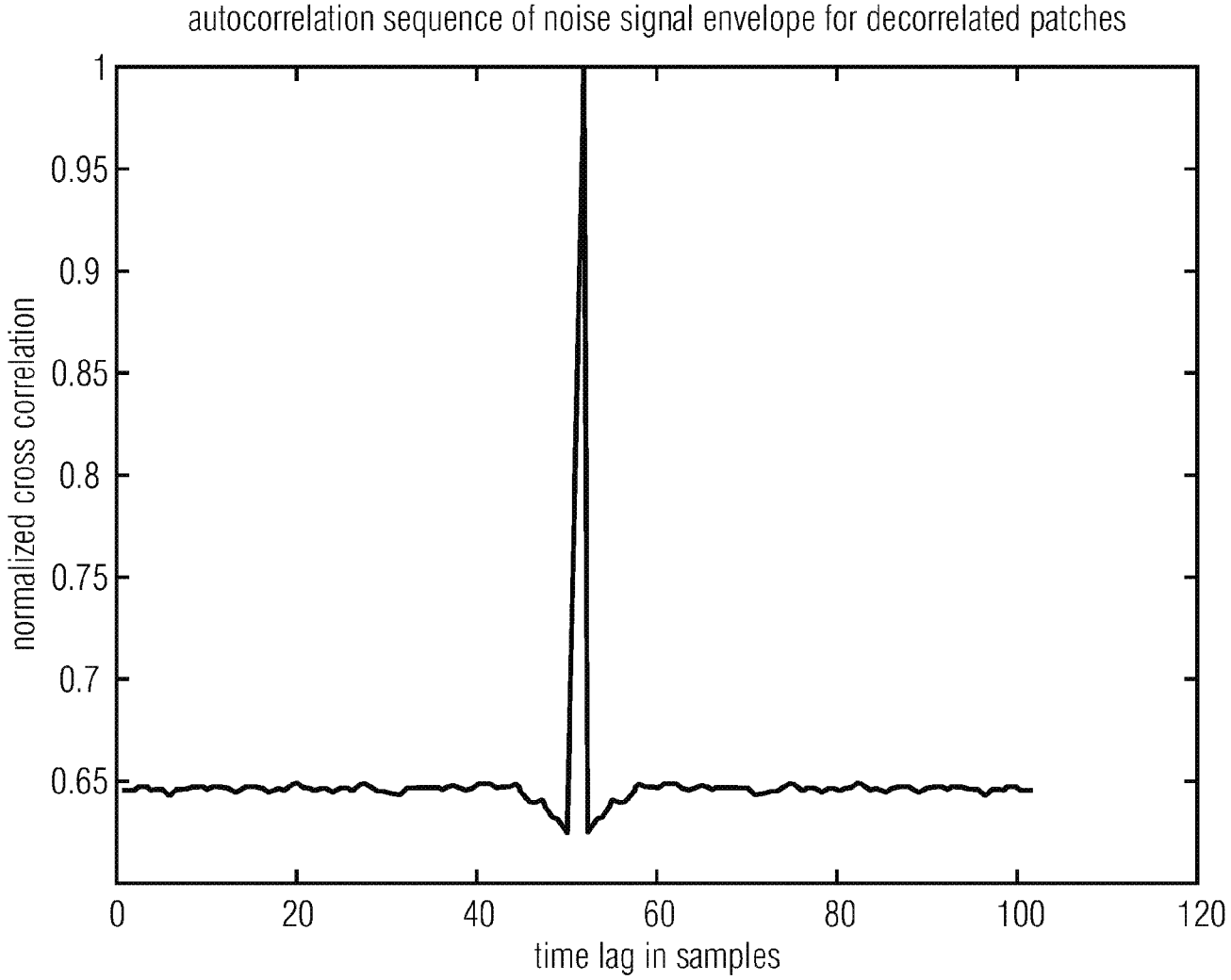

The advantageous effect achieved by the inventive approach can be made visible by a comparison of the autocorrelation sequence of the noise signal envelope for copy-up SBR (shown in FIG. 5*a*) with the autocorrelation sequence of the noise signal envelope of decorrelated patches as shown in FIG. 5*b* of the present application. FIG. 5*b* is the autocorrelation function of the magnitude envelope of white noise, wherein the bandwidth is extended with three patches uncorrelated among each other and to the LF band. FIG. 5*b* clearly shows the disappearance of the unwanted side maxima shown in FIG. 5*a*.

The present application is applicable or suitable for all audio applications in which the full bandwidth is not available. The inventive approach may find use in the distribution or broadcasting of audio content such as, for example with digital radio, internet streaming and audio communication applications. Embodiments of the invention are related to a bandwidth extension using decorrelated sub-band audio signals.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a tangible machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for reproducing an audio signal based on first data representing a coded version of a first portion of the audio signal in a first frequency band and second data representing side information on a second portion of the audio signal in a second frequency band, the second frequency band comprising frequencies higher than the first frequency band, said device comprising:

a first reproducer configured to reproduce the first portion of the audio signal based on the first data;

a provider configured to provide a patch signal in the second frequency band, wherein the patch signal is at least partially uncorrelated with respect to the first portion of the audio signal or is at least partially a decorrelated version of the first portion of the audio signal, which has been shifted to the second frequency band;

a second reproducer representing a post-processor and configured to reproduce the second portion of the audio signal in the second frequency band based on the second data and the patch signal by post-processing the patch signal based on the second data, wherein a spectral envelope of the second portion of the audio signal, a noise floor in the second portion of the audio signal, a tonality measure for each partial band in the second portion of the audio signal, and an explicit coding of prominent sinusoidal portions in the second portion of the audio signal represent side information represented by the second data; and a combiner to combine the reproduced first portion of the audio signal and the patch signal before the second portion of the audio signal is reproduced by the second reproducer or to combine the reproduced first portion of the audio signal and the reproduced second portion of the audio signal, wherein the provider is to provide the patch signal before the patch signal is post-processed by the second reproducer based on the second data.

2. The apparatus of claim 1, wherein the second reproducer is configured to reproduce the audio signal in the second frequency band based on the second data and the patch signal if the first portion of the audio signal does not comprise an indicator for a strong correlation between the first portion of the audio signal and the second portion of the audio signal and wherein the second reproducer is configured to reproduce the audio signal in the second frequency band based on the second data and a version of the first portion of the audio signal, which has been shifted to the second frequency band and which has not been decorrelated, if the first portion of the audio signal comprises an indicator for a strong correlation between the first portion of the audio signal and the second portion of the audio signal.

3. The apparatus of claim 1, wherein the provider is configured to provide a synthetic patch signal which is uncorrelated with respect to the first portion of the audio signal.

4. The apparatus of claim 3, wherein the synthetic patch signal is a noise signal.

5. The apparatus of claim 1, wherein the provider comprises a shifting unit and a decorrelator, which are configured to generate the patch signal as a decorrelated version of the first portion of the audio signal shifted to the second frequency band.

6. The apparatus of claim 5, wherein the decorrelator is configured to preserve at least one of a spectral envelope of the first portion of the audio signal and a temporal envelope of the first portion of the audio signal.

7. The apparatus of claim 5, wherein the decorrelator comprises one of:

an all-pass filter configured to cause group-delay variations in the first portion of the audio signal;

a phase randomizer configured to cause phase randomization of spectral coefficients of the first portion of the audio signal; and an applicator configured to apply a frequency-dependent time delay to sub-portions the first portion of the audio signal.

8. The apparatus of claim 5, wherein the decorrelator comprises a signal adaptive decorrelator configured to vary the degree of decorrelation in order to apply a higher decorrelation if the first portion of the audio signal does not comprise an indicator for a strong correlation between the first portion of the audio signal and the second portion of the audio signal and to apply a lower decorrelation or not to apply a decorrelation if the first portion of the audio signal comprises an indicator for a strong correlation between the first portion of the audio signal and the second portion of the audio signal.

9. The apparatus of claim 2, comprising a detector configured to detect whether the first signal portion of the audio signal comprises the indicator for a strong correlation between the first portion of the audio signal and the second portion of the audio signal.

10. The apparatus of claim 1, wherein the provider is configured to provide a second patch signal in a third frequency band, wherein the second patch signal is uncorrelated with respect to the first portion of the audio signal or is a decorrelated version of the first portion of the audio signal, which has been shifted to the third frequency band, wherein the second patch signal is uncorrelated or decorrelated with respect to the first patch signal, wherein the apparatus comprises a third reproducer, wherein the third reproducer is configured to reproduce a third portion of the audio signal based on the second patch signal and third data representing side information on the third portion of the audio signal in the third frequency band, the third frequency band comprising frequencies higher than the second frequency band.

11. A method for reproducing an audio signal based on first data representing a coded version of a first portion of the audio signal in a first frequency band and second data representing side information on a second portion of the audio signal in a second frequency band, the second frequency band comprising frequencies higher than the first frequency band, said method comprising:

reproducing the audio signal in the first frequency band based on the first data;

providing a patch signal in the second frequency band, wherein the patch signal is at least partially uncorrelated with respect to the first portion of the audio signal or is at least partially a decorrelated version of the first portion of the audio signal, which has been shifted to the second frequency band;

reproducing the second portion of the audio signal in the second frequency band based on the second data and the patch signal by means of a post-processor post-processing the patch signal based on the second data, wherein a spectral envelope of the second portion of the audio signal, a noise floor in the second portion of the audio signal, a tonality measure for each partial band in the second portion of the audio signal, and an explicit coding of prominent sinusoidal portions in the second portion of the audio signal represent side information represented by the second data; and combining the reproduced first portion of the audio signal and the patch signal before the second portion of the audio signal is reproduced or combining the reproduced first portion of the audio signal and the reproduced second portion of the audio signal, wherein the patch signal is provided before the patch signal is post-processed by the post-processor based on the second data.

12. An apparatus for generating a coded audio signal, the coded audio signal comprising first data representing a coded version of a first portion of the audio signal in a first frequency band and second data representing side information on a second portion of the audio signal in a second frequency band, the second frequency band comprising frequencies higher than the first frequency band, comprising:

a decorrelation information adder configured to add to the coded audio signal in addition to the first data and the second data information on a degree of decorrelation to be used between the first portion of the audio signal and a patch signal based on which the second portion of the audio signal is reproduced by means of a post-processor when reproducing the audio signal from the coded audio signal, wherein a spectral envelope of the second portion of the audio signal, a noise floor in the second portion of the audio signal, a tonality measure for each partial band in the second portion of the audio signal, and an explicit coding of prominent sinusoidal portions in the second portion of the audio signal represent side information represented by the second data, and wherein the information on a degree of decorrelation is to be used before the patch signal is post-processed based on the second data by the post-processor in reproducing the second portion of the audio signal.

13. A method for generating a coded audio signal, the coded audio signal comprising first data representing a coded version of a first portion of the audio signal in a first frequency band and second data representing side information on a second portion of the audio signal in a second frequency band, the second frequency band comprising frequencies higher than the first frequency band, comprising:

adding to the coded audio signal in addition to the first data and the second data information on a degree of decorrelation to be used between the first portion of the audio signal and a patch signal based on which the second portion of the audio signal is reproduced by means of a post-processor when reproducing the audio signal from the coded audio signal, wherein a spectral envelope of the second portion of the audio signal, a noise floor in the second portion of the audio signal, a tonality measure for each partial band in the second portion of the audio signal, and an explicit coding of prominent sinusoidal portions in the second portion of the audio signal represent side information represented by the second data, and wherein the information on a degree of decorrelation is to be used before the patch signal is post-processed based on the second data by the post-processor in reproducing the second portion of the audio signal.

14. A non-transitory storage medium having stored thereon a computer program comprising program code for performing a method according to claim 11 when the computer program runs on a computer.

15. A non-transitory storage medium having stored thereon a computer program comprising program code for performing a method according to claim 13 when the computer program runs on a computer.

* * * * *